US009900697B2

(12) United States Patent
Jiang et al.

(10) Patent No.: US 9,900,697 B2
(45) Date of Patent: Feb. 20, 2018

(54) MULTI-DIAPHRAGM SPEAKER SYSTEM

(71) Applicant: GOERTEK INC., WeiFang (CN)

(72) Inventors: Chao Jiang, WeiFang (CN); Jianbin Yang, WeiFang (CN); Zhi Li, WeiFang (CN)

(73) Assignee: GOERTEK INC., Weifang (CN)

( * ) Notice: Subject to any disclaimer, the term of this patent is extended or adjusted under 35 U.S.C. 154(b) by 4 days.

(21) Appl. No.: 15/114,319

(22) PCT Filed: May 22, 2014

(86) PCT No.: PCT/CN2014/078112

§ 371 (c)(1),
(2) Date: Jul. 26, 2016

(87) PCT Pub. No.: WO2015/109699

PCT Pub. Date: Jul. 30, 2015

(65) Prior Publication Data

US 2017/0013362 A1 Jan. 12, 2017

(30) Foreign Application Priority Data

Jan. 26, 2014 (CN) ..... 2014 2 0051024 U

(51) Int. Cl.
*H04R 25/00* (2006.01)
*H04R 7/12* (2006.01)
(Continued)

(52) U.S. Cl.
CPC ..... *H04R 7/127* (2013.01); *H04R 1/323* (2013.01); *H04R 9/063* (2013.01)

(58) Field of Classification Search
CPC ..... H04R 9/063; H04R 7/127; H04R 7/18; H04R 9/025; H04R 1/323
(Continued)

(56) References Cited

U.S. PATENT DOCUMENTS 3,636,278 A * 1/1972 Heil ..... H04R 7/14 381/163
4,039,044 A * 8/1977 Heil ..... H04R 1/02 181/144
2009/0190791 A1* 7/2009 Unruh ..... H04R 9/063 381/398

FOREIGN PATENT DOCUMENTS

CN 1977564 A 6/2007
CN 101656906 A 2/2010
(Continued)

OTHER PUBLICATIONS

International Search Report for International Patent Application No. PCT/KR2014/078112 dated May 22, 2014.
(Continued)

*Primary Examiner* — Sean H Nguyen

(57) ABSTRACT

A multi-diaphragm speaker system comprises a speaker apparatus and a front/rear cavity sealing apparatus. The speaker apparatus comprises at least four diaphragms. Cavities of the speaker apparatus are formed between every two adjacent diaphragms of the speaker apparatus. The cavities that are spaced apart from each other jointly form a first acoustic cavity of the speaker apparatus. The cavities adjacent to the first acoustic cavity form a second acoustic cavity of the speaker apparatus. The first acoustic cavity and the second acoustic cavity are separated via the front/rear cavity sealing apparatus. Utilization of the present utility model solves the problem of speaker front/rear cavity separation.

9 Claims, 2 Drawing Sheets

(51) Int. Cl.
*H04R 9/06* (2006.01)
*H04R 1/32* (2006.01)

(58) Field of Classification Search
USPC ..... 381/186
See application file for complete search history.

(56) References Cited

FOREIGN PATENT DOCUMENTS

| | | | |
|---|---|---|---|
| CN | 102469393 | A | 5/2012 |
| CN | 103297904 | A | 9/2013 |
| CN | 203301728 | U | 11/2013 |

OTHER PUBLICATIONS

Office Action from Korean Patent Office for Application No. 10-2016-7023668 dated Apr. 10, 2017.

* cited by examiner

MULTI-DIAPHRAGM SPEAKER SYSTEM

CROSS-REFERENCE TO RELATED APPLICATIONS

The present specification is a U.S. National Stage of International Patent Application No. PCT/CN2014/078112 filed May 22, 2014, which claims priority to and the benefit of Chinese Patent Application No. 201420051024.5 filed in the Chinese Intellectual Property Office on Jan. 26, 2014, the entire contents of which are incorporated herein by reference.

TECHNICAL FIELD

The present utility model relates to the technical field of acoustoelectric conversion, more specifically, to a multi-diaphragm speaker system.

BACKGROUND ART

There is a wide range of speakers, wherein audio power enables cones or diaphragms vibrating and resonating with ambient air to generate sound through galvanomagnetic effect, piezoelectric effect or electrostatic effect.

Speakers with conventional structures comprise diaphragms and a driving unit. Wherein the driving unit comprise a center suspension, which is typically disposed under the first diaphragm to prevent the product from polarization. Typically, several round diaphragms are utilized, and connecting rods penetrate through the diaphragms and connect the diaphragms together. However, air leakage occurs at the opening through which the connecting rods penetrate the diaphragms due to air draught, resulting in leakage effects, such as, intermodulation, harmonic distortion and turbulent noise which results in poor sound quality.

In order to solve the problem of air leakage, diaphragms are connected by inner connecting rods and outer connecting rods, in such a way that the connecting rods do not penetrating through the diaphragms. However, as connecting rods are utilized, there is a new problem of airtightness between the front and rear cavities, that is, the rear cavity of the speaker being in communication with the front cavity formed between the housings and connected by the outer connecting rods. Nevertheless, the front and rear cavities of the speaker are required to be separated to enable the rear cavity of the speaker to form a completely sealed rear cavity. Thus, based on the case that the housings are connected by outer connecting rods, the structure of the speaker is required to be improved.

SUMMARY

In view of the above problems, an objective of the present utility model is to provide a multi-diaphragm speaker system to solve the problem that the front and rear cavities of the speaker are required to be separated.

The present utility model provides a multi-diaphragm speaker system which comprises a speaker device and a front-rear cavity sealing device; wherein, the speaker device comprises at least four diaphragms;

a plurality of cavities of the speaker device are respectively formed between every two adjacent diaphragms of the speaker device, wherein, cavities that are spaced apart from each other jointly form a first acoustic cavity of the speaker device, and a cavity or cavities adjacent to the first acoustic cavity form a second acoustic cavity of the speaker device;

the first acoustic cavity and the second acoustic cavity are separated through the front-rear cavity sealing device.

Moreover, it is preferred that the speaker device further comprises inner connecting rods and outer connecting rods;

diaphragms located at odd-numbered positions are interconnected through the inner connecting rods to form a first group of diaphragms, and the inner connecting rods connected with the diaphragms located at odd-numbered positions are connected through the outer connecting rods; the diaphragms in the first group of diaphragms vibrate in a same direction;

and diaphragms located at even-numbered positions are interconnected through the inner connecting rods to form a second group of diaphragms, and the inner connecting rods connected with the diaphragms located at even-numbered positions are connected through the outer connecting rods; the diaphragms in the second group of diaphragms vibrate in a same direction;

a vibrating direction of the first group of diaphragms is opposite to that of the second group of diaphragms.

Moreover, it is preferred that the inner connecting rods are connected to rigid domes of the diaphragms through connection points provided on the diaphragms.

Moreover, it is preferred that the first acoustic cavity forms a front acoustic cavity of the multi-diaphragm speaker system, and the second acoustic cavity forms a rear acoustic cavity of the multi-diaphragm speaker system.

Moreover, it is preferred that the front-rear cavity sealing device comprises a front cavity sealing device and a rear cavity sealing device, and the rear cavity sealing device comprises first rear cavity sealing housings and a second rear cavity sealing housing.

Moreover, it is preferred that the front cavity sealing device is disposed at an opening of the first acoustic cavity, which opening is provided at one side of the first acoustic cavity, so as to separate the first acoustic cavity and the second acoustic cavity.

Moreover, it is preferred that each of the first rear cavity sealing housings is disposed at one end of another opening of the first acoustic cavity, which opening is provided at another side of the first acoustic cavity, and the second rear cavity sealing housing is connected with an opening of the second acoustic cavity, which opening is provided at one side of the second acoustic cavity.

As can be seen from the above technical solutions, in the speaker provided by the present utility model, diaphragms are interconnected through inner connecting rods and outer connecting rods without the connecting rods penetrating through the diaphragms, and the first housings connected with the outer connecting rods are hermetically connected through the front cavity sealing device to separate the front and rear cavities of the speaker.

BRIEF DESCRIPTION OF THE DRAWINGS

By referring to the descriptions in connection with the accompanying drawings and the contents of the claims, and with a full understanding of the present utility model, other purposes and results of the present utility model will be more clearly and easily understand.

In the drawings.

Figure 1:
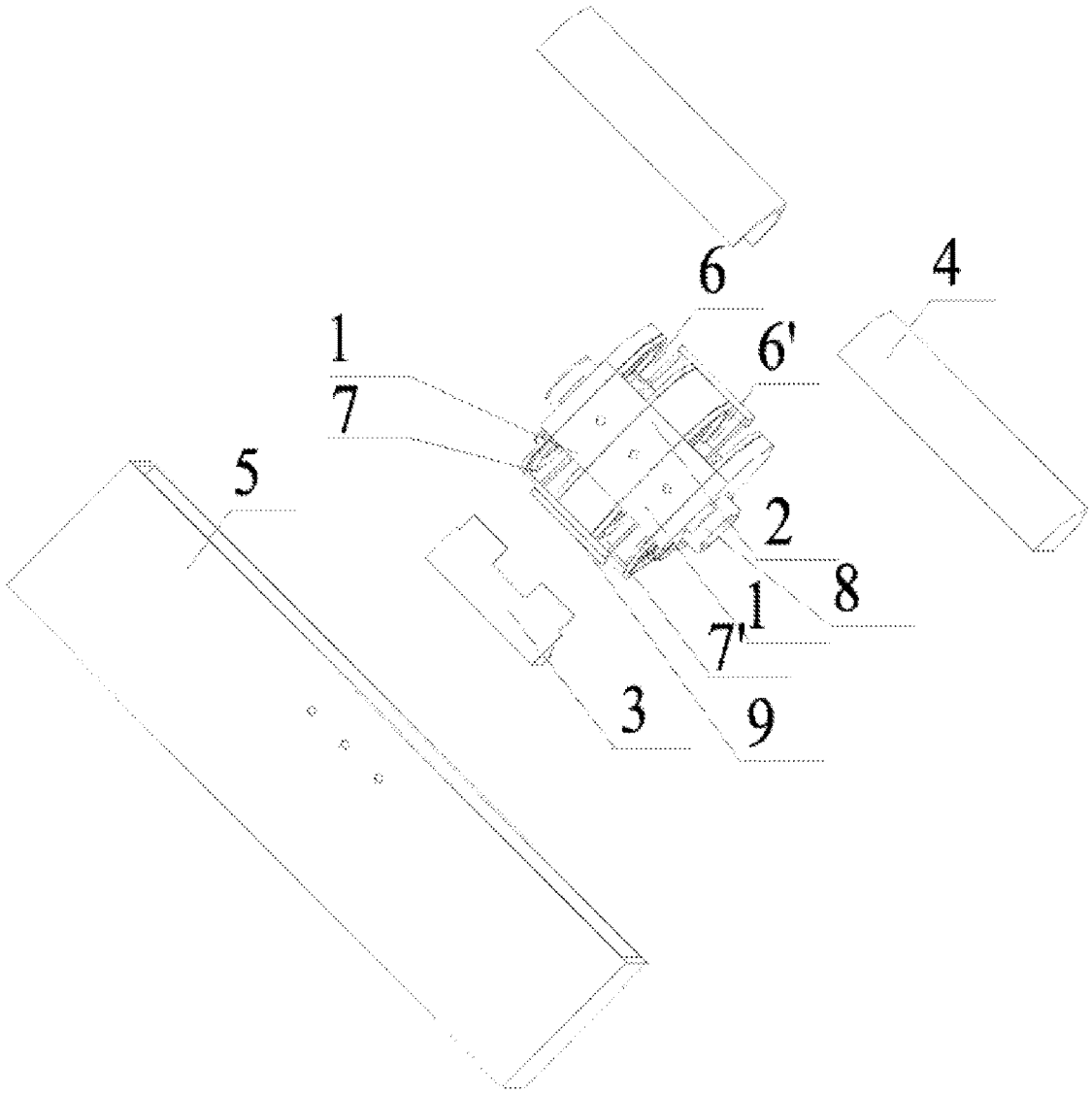
FIG. 1 is a schematic view of breakdown structure of the speaker system with four diaphragms according to the embodiments of the present utility model.

Wherein, reference numerals comprise: first housing 1, second housing 2, front cavity sealing device 3, first rear cavity sealing housing 4, second rear cavity sealing housing 5, 180 degrees openings 6 and 6' of first housings, 90 degrees openings 7 and 7' of first housings, magnetic circuit 8, outer connecting rod 9, diaphragm 10.

Same reference numerals in all of the accompanying drawings indicate similar or corresponding features or functions.

DETAILED DESCRIPTION OF EMBODIMENTS

Hereinafter, particular embodiments of the present utility model are described in connection with the accompanying drawings.

In the present utility model, the radiating area of the speaker device is increased through a plurality of diaphragms, and thus the diaphragms located at odd-numbered positions and the diaphragms located at even-numbered positions are respectively connected through outer connecting rods to constitute two groups of diaphragms, and the cavities formed between the individual diaphragms are covered by the housings to achieve sealing. Meanwhile, as the outer connecting rods are utilized in the speaker, the sealing device is added to separate the front cavity and rear cavity of the speaker.

As the inner connecting rods and the outer connecting rods are utilized in the present utility model, in the manufacturing process of the speaker, connection of the diaphragms can be achieved without requiring penetration of the diaphragms, thereby preventing occurrences of air leakage and poor sound quality, improving sound efficiency of the speaker, and decreasing the difficulty for manufacturing the speaker as well.

The individual components of the multi-diaphragm speaker system provided by the present utility model and their connection relationships are described synoptically above, and the connection relationships of the individual components of the multi-diaphragm speaker system provided by the present utility model will be described in details below.

The multi-diaphragm speaker system provided by the present utility model comprises a speaker device and a front-rear cavity sealing device; the speaker device comprises at least four diaphragms; a plurality of cavities of the speaker device are respectively formed between every two adjacent diaphragms of the speaker device, wherein, cavities that are spaced apart from each other jointly form a first acoustic cavity of the speaker device, and a cavity or cavities adjacent to the first acoustic cavity form a second acoustic cavity of the speaker device; the first acoustic cavity and the second acoustic cavity are separated through the front-rear cavity sealing device.

Wherein, the speaker device further comprises inner connecting rods and outer connecting rods; diaphragms located at odd-numbered positions are interconnected through the inner connecting rods to form a first group of diaphragms, and inner connecting rods connected with the diaphragms located at odd-numbered positions are connected through the outer connecting rods; the diaphragms in the first group of diaphragms vibrate in a same direction; and diaphragms located at even-numbered positions are interconnected through the inner connecting rods to form a second group of diaphragms, and inner connecting rods connected with the diaphragms located at even-numbered positions are connected through the outer connecting rods; the diaphragms in the second group of diaphragms vibrate in a same direction; the vibrating direction of the first group of diaphragms is opposite to that of the second group of diaphragms. In addition, the inner connecting rods are connected to the rigid domes of the diaphragms through connection points provided on the diaphragms.

It should be noted that connection points are provided on the diaphragms, which are connected with the inner connecting rods through the connection points. And, the inner connecting rods comprise long rods and short rods, and long rod(s) and short rod(s) of the inner connecting rods in the first group of diaphragms are mutually staggered; meanwhile, long rod(s) and short rod(s) of the inner connecting rods in the second group of diaphragms are mutually staggered, and the long rod(s) and short rod(s) of the inner connecting rods in the starting diaphragms of the first group of diaphragms and the second group of diaphragms are mutually staggered as well. In addition, the inner connecting rods are connected to the rigid domes of four diaphragms through connection points provided on the diaphragms.

As the speaker device functions mainly based on the vibration of the diaphragms to produce sound and the diaphragms vibrate with certain amplitudes, in order to control the amplitudes of the diaphragms when the diaphragms vibrate, it can effectively suppress swing mode and bending vibration mode of the diaphragms that the connecting rods are placed at different positions on the rigid domes of the diaphragms. In the first and second groups of diaphragms, it is more conducive to suppress flexural vibration of the diaphragms that each of the long rods of the inner connecting rods is connected with one diaphragm in a ½ region of the major axis of rigid dome of the diaphragm, and each of the short rods of the inner connecting rods is connected with one diaphragm in a ¼ region of the major axis of rigid dome of the diaphragm.

Particularly, in the present utility model, the first acoustic cavity forms a front acoustic cavity of the multi-diaphragm speaker system, and the second acoustic cavity forms a rear acoustic cavity of the multi-diaphragm speaker system. The front-rear cavity sealing device comprises a front cavity sealing device and a rear cavity sealing device. The rear cavity sealing device comprises first rear cavity sealing housings and a second rear cavity sealing housing. The front cavity sealing device of the front-rear cavity sealing device is disposed at an opening of the first acoustic cavity, which opening is provided at one side of the first acoustic cavity, so as to separate the first acoustic cavity and the second acoustic cavity. Each of the first rear cavity sealing housings is disposed at one end of another opening of the first acoustic cavity, which opening is provided at another side of the first acoustic cavity, and the second rear cavity sealing housing is connected with an opening of the second acoustic cavity, which opening is provided at one side of the second acoustic cavity.

It should be noted that the front acoustic cavity and rear acoustic cavity of the multi-diaphragm speaker system are not limited, the first acoustic cavity may be the rear acoustic cavity of the multi-diaphragm speaker system, and the second acoustic cavity may be the front acoustic cavity of the multi-diaphragm speaker as well.

The outer connecting rods are connected with the inner connecting rods through the openings of the first acoustic cavity, and the first acoustic cavities formed by individual diaphragms of the first group of diaphragms are connected together through the outer connecting rods connected to the inner connecting rods of the first group of diaphragms. The second acoustic cavity formed by individual diaphragms in the second group of diaphragms is provided with an opening as well, and the positions of the opening of the second acoustic cavity and the openings of the first cavity are mutually staggered.

It should be noted that individual cavities formed by individual diaphragms of the first group of diaphragms are in communication with each other, because the first group of diaphragms are connected through the inner connecting rods and the outer connecting rods, during interconnection, the individual cavities formed by the first group of diaphragms are provided with openings which are used for interconnecting the inner connecting rods and the outer connecting rods, and thus the individual cavities formed by the first group of diaphragms are connected to form a relatively larger cavity, i.e., the first acoustic cavity, due to the design of the openings. In the present utility model, as individual cavities formed by individual diaphragms of the second group of diaphragms are required to be connected to form a relatively larger cavity, openings are provided on the individual cavities formed by the individual diaphragms of the second group of diaphragms, and the openings are designed for enabling the individual cavities formed by the individual diaphragms of the second group of diaphragms to be connected to form a large cavity, i.e., the second acoustic cavity.

In order to enable individual small cavities formed by individual diaphragms of the first group of diaphragms to be a independent first acoustic cavity, the front cavity sealing device is provided on individual cavities formed by the first group of diaphragms, so that the front cavity sealing device separates the front and rear acoustic cavities. In order to enable individual independent cavities formed by individual diaphragms of the second group of diaphragms to be connected to form a large cavity, i.e., the second acoustic cavity, a rear cavity sealing device is still needed.

The relatively larger cavity formed by individual small cavities of the first group of diaphragms, i.e., the first acoustic cavity, may be used as a front cavity, and if it is used as the front cavity, openings are additionally provided at the positions opposite to the openings of the individual small cavities so as to be in communication with the outside of the speaker. The relatively larger cavity (the first acoustic cavity) formed by individual small cavities of the first group of diaphragms may be used as a rear cavity, and because the front cavity sealing device is disposed at the opening position where the inner connecting rods and the outer connecting rods are connected to the first acoustic cavity, the rear cavity is a sealed device. The relatively larger cavity formed by individual small cavities of the second group of diaphragms and the rear cavity sealing device, i.e., the second acoustic cavity, may be used as the front cavity, and if it is used as the front cavity, an opening is provided at a position on the rear cavity sealing device, so that the front cavity is in communication with the outside of the speaker; and if it is used as the rear cavity, the rear cavity sealing device is directly provided at positions of all openings of the individual cavities formed by the second group of diaphragms, so as to be connected with the individual cavities formed by the second group of diaphragms, thereby forming a sealed rear cavity.

In the present utility model, the radiation scope of the speaker is improved by using a plurality of diaphragms, and the number of the diaphragms may be an even number, or may be an odd number, but at least four. Hereinafter, a speaker device with four diaphragms is taken as an example, and particular embodiments of the present utility model are described in connection with the accompanying drawings.

Figure 2:
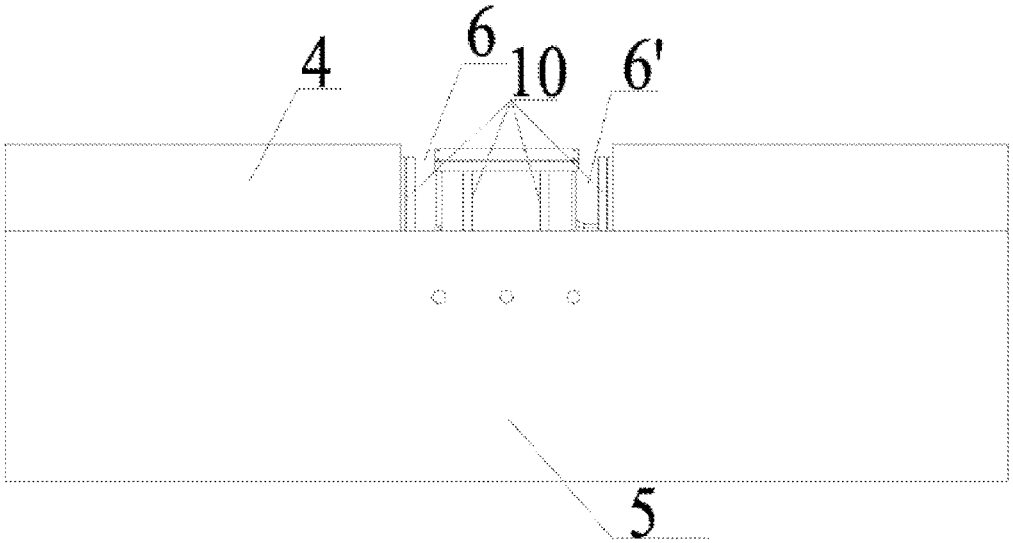
FIG. 2 is a side view of the speaker system with four diaphragms according to the embodiments of the present utility model.

FIG. 1 and FIG. 2 show breakdown structure and side-view structure of the speaker system with four diaphragms according to the embodiments of the present utility model respectively.

As shown in FIG. 1 and FIG. 2, the speaker system with four diaphragms provided by the present utility model comprises a speaker device and a front-rear cavity sealing device, wherein, the speaker device comprises four diaphragms 10, inner connecting rods, outer connecting rods 9 and magnetic circuits 8. Cavities of the speaker device are formed between every two adjacent diaphragms 10, wherein, cavities that are spaced apart from each other jointly form a first acoustic cavity of the speaker device, i.e., form the front acoustic cavity of the multi-diaphragm speaker system, and a cavity or cavities adjacent to the first acoustic cavity form a second acoustic cavity of the speaker device, i.e., form(s) the rear acoustic cavity of the multi-diaphragm speaker system. The first acoustic cavity and the second acoustic cavity are separated through the front-rear cavity sealing device.

Particularly, the speaker system with four diaphragms comprises a pair of first housings 1, a second housing 2, a front-rear cavity sealing device, at least four diaphragms 10, inner connecting rods (not illustrated in the figures), outer connecting rods 9, and magnetic circuits 8. The front-rear cavity sealing device comprises a front cavity sealing device 3 and a rear cavity sealing device. Wherein, the rear cavity sealing device comprises a pair of first rear cavity sealing housings 4 and a second rear cavity sealing housing 5.

Wherein, both ends of the first housing 1 or the second housing 2 are arc-shaped, and each of the first housing 1 and second housing 2 has a racetrack or oval shape. That is, in the present utility model, each of the first housing 1 and second housing 2 may has a racetrack shape, or may has a oval shape as well, and both ends of the racetrack shape or oval shape are arc-shaped.

As illustrated in FIG. 1, a 180 degrees opening 6 and a 90 degrees opening 7 are provided on the first housing 1, wherein, the 180 degrees opening 6 is provided at a position of an arc of one end of the two ends of the first housing 1, and the 90 degrees opening 7 is provided on an arc of another end of the two ends of the first housing 1 opposite to the position of the 180 degrees opening 6.

Both of the two 180 degrees openings 6 and 6' on the pair of first housings 1 are in communication with the outside of the speaker, and two 90 degrees openings 7 and 7' on the pair of first housings 1 are interconnected through outer connecting rods 9.

That is, the number of the diaphragms of the speaker is at least four, outer connecting rods 9 are provided between the 90 degrees opening 7 and the 90 degree opening 7' of the pair of first housings 1. The diaphragms are connected with the inner connecting rods, and the inner connecting rods (not illustrated in figures) are connected through outer connecting rods, and inner connecting rods are connected to the rigid domes of the diaphragms through connection points provided on the diaphragms 10. Diaphragms located at odd-numbered positions are interconnected through the inner connecting rods to form a first group of diaphragms, and inner connecting rods connected with the diaphragms located at odd-numbered positions are connected through the outer connecting rods 9; the diaphragms in the first group of diaphragms vibrate in a same direction; and diaphragms located at even-numbered positions are interconnected through the inner connecting rods to form a second group of diaphragms, and inner connecting rods connected with the diaphragms located at even-numbered positions are connected through the outer connecting rods 9; the diaphragms in the second group of diaphragms vibrate in a same direction. The vibrating direction of the first group of diaphragms is opposite to that of the second group of diaphragms.

It should be noted that, in the present utility model, the degree of the opening on the housing is not limited to a specific degree, and may be determined according to the actual situation. It is a preferred embodiment that a 180 degrees opening or 90 degrees opening is provided on the housing.

It should be noted that each of the diaphragms comprises a rigid dome at the center position and a suspension ring portion at the edge position, and the rigid domes of the diaphragms mentioned in the present utility model means the rigid portions at center positions of the diaphragms.

It should be further noted that the diaphragms are divided into two groups, i.e., an odd-numbered group and an even-numbered group, wherein, while driving the diaphragms, a group of magnetic circuits are required to drive the diaphragms, and one magnetic circuit drives the diaphragms of the odd-numbered group to vibrate, another magnetic circuit drives the diaphragms of the even-numbered group to vibrate.

An 90 degrees opening (not illustrated in figures) is provided on the second housing 2; wherein, the second housing 2 is provided between the pair of first housings 1, and 180 degrees openings 6 and 6' and 90 degrees openings 7 and 7' of the pair of first housings 1 correspond to each other respectively, and the positions of the 90 degrees opening of the second housing and the 90 degrees openings 7 and 7' of the first housing are mutually staggered, wherein, each of the pair of first housings 1 forms a small front cavity, and the second housing forms a small rear cavity.

That is, when the pair of first housings 1 and second housing 2 are installed, the 180 degrees opening 6 and the 180 degrees opening 6' of two first housings 1 correspond to each other, and the 90 degrees opening 7 and the 90 degrees opening 7' of two first housings 1 correspond to each other. However, the positions of the 90 degrees opening of the second housing and the 90 degrees openings 7 and 7' of the first housing are mutually staggered, the pair of first housings 1 form two small front cavities of the speaker, and the second housing forms a small rear cavity of the speaker.

Wherein, it should be noted that it is intended to make preparation for sealing the rear cavity that the positions of the 90 degrees opening of the second housing and the 90 degrees openings 7 and 7' of the first housing are mutually staggered. The 90 degrees opening of the second housing is connected with the rear cavity sealing device, and meanwhile, the front cavity sealing device interconnects two small front cavities and is capable of insulating from the whole rear cavity sealing device completely.

In the present utility model, the front cavity sealing device 3 is provided at the position of the 90 degrees openings 7 and 7' of the first housing, so that the front cavity sealing device 3 is in communication with two first housings, and forms a large front cavity together with two small front cavities formed by the pair of first housings.

The pair of first rear cavity sealing housings 4 are respectively provided at one end of the 180 degrees openings 6 of the pair of first housings, and the 180 degrees openings 6 of the two first housings are in communication with the outside of the speaker.

The second rear cavity sealing housing 5 is connected with the 90 degrees opening of the second housing 2. The small rear cavity of the speaker formed by the second housing 2 is interconnected with the sealed space formed by the second rear cavity sealing housing 5 and the pair of first rear cavity sealing housings 4, through the 90 degrees opening of the second housing 2, so as to form a large rear cavity of the speaker; in addition, the front cavity sealing device 3 separates the sealed space and the large front cavity of the speaker.

That is, the second rear cavity sealing housing 5 and the pair of first rear cavity sealing housings 4 form a sealed space, and the sealed space is interconnected with the small rear cavities through the 90 degrees opening of the second housing, to form a large rear cavity in which a front cavity sealing device 3 is further disposed. The front cavity sealing device 3 enables the large rear cavity to be isolated from the front cavity completely, so as to form a sealed large rear cavity. Thus, the design of the front cavity sealing device 3 enables the sounds of the front and rear cavities of the speaker to be separated completely.

It should be noted that when solving the problem of air leakage of the speaker, individual diaphragms are connected through inner connecting rods and outer connecting rods in such a way that the individual diaphragms are connected without penetrating through the diaphragms. As the outer connecting rods are utilized, two small front cavities are in communication with the large rear cavity through the 90 degrees openings of the first housings; in order to separate the front and rear cavities, the front cavity sealing device 3 is utilized.

As can be seen from the above embodiments, in the multi-diaphragm speaker system provided by the present utility model, individual diaphragms are connected without penetrating through the diaphragms, individual diaphragms are connected through the inner connecting rods and outer connecting rods, and the first housings connected with the outer connecting rods are hermetically connected through the front cavity sealing device to separate the front and rear cavities of the speaker, which ensures sound isolation for the front and rear cavities of the speaker, and enables the problem of air leakage to be solved.

As described above, the multi-diaphragm speaker system provided by the present utility model is described by way of example with reference to the accompanying drawings. However, it should be understood by those skilled in the art that various improvements can be made to the multi-diaphragm speaker system provided by the present utility model abovementioned without departing from the scope of the present utility model. Thus, the scope of the present utility model should be defined by the appended claims.

The invention claimed is:

1. A multi-diaphragm speaker system, characterized by comprising a speaker device and a front-rear cavity sealing device; wherein, the speaker device comprises at least four diaphragms;

a plurality of cavities of the speaker device are respectively formed between every two adjacent diaphragms of the speaker device, wherein, cavities that are spaced apart from each other jointly form a first acoustic cavity of the speaker device, and a cavity or cavities adjacent to the first acoustic cavity form a second acoustic cavity of the speaker device;

the first acoustic cavity and the second acoustic cavity are separated through the front-rear cavity sealing device; and the front-rear cavity sealing device comprises a front cavity sealing device and a rear cavity sealing device, and the front cavity sealing device interconnects the cavities that are spaced apart from each other and jointly form the first acoustic cavity of the speaker device.

2. The multi-diaphragm speaker system according to claim 1, characterized in that, the speaker device further comprises inner connecting rods and outer connecting rods;

diaphragms located at odd-numbered positions are interconnected through the inner connecting rods to form a first group of diaphragms, the inner connecting rods connected with the diaphragms located at odd-numbered positions are connected through the outer connecting rods, and the diaphragms in the first group of diaphragms vibrate in a same direction;

diaphragms located at even-numbered positions are interconnected through the inner connecting rods to form a second group of diaphragms, the inner connecting rods connected with the diaphragms located at even-numbered positions are connected through the outer connecting rods, and the diaphragms in the second group of diaphragms vibrate in a same direction; and a vibrating direction of the first group of diaphragms is opposite to that of the second group of diaphragms.

3. The multi-diaphragm speaker system according to claim 2, characterized in that, the inner connecting rods are connected to rigid domes of the diaphragms through connection points provided on the diaphragms.

4. The multi-diaphragm speaker system according to claim 1, characterized in that, the first acoustic cavity forms a front acoustic cavity of the multi-diaphragm speaker system, and the second acoustic cavity forms a rear acoustic cavity of the multi-diaphragm speaker system.

5. The multi-diaphragm speaker system according to claim 1, characterized in that, the rear cavity sealing device comprises a first rear cavity sealing housings and a second rear cavity sealing housing.

6. The multi-diaphragm speaker system according to claim 5, characterized in that, the front cavity sealing device is disposed at an opening of the first acoustic cavity, which opening is provided at one side of the first acoustic cavity, so as to separate the first acoustic cavity and the second acoustic cavity.

7. The multi-diaphragm speaker system according to claim 6, characterized in that, each of the first rear cavity sealing housings is disposed at one end of another opening of the first acoustic cavity, which opening is provided at another side of the first acoustic cavity, and the second rear cavity sealing housing is connected with an opening of the second acoustic cavity, which opening is provided at one side of the second acoustic cavity.

8. The multi-diaphragm speaker system according to claim 1, characterized in that first, second, third and fourth diaphragms are arranged in consecutive order; and the first acoustic cavity connects a space between the first and second diaphragms and a space between the third and fourth diaphragms.

9. The multi-diaphragm speaker system according to claim 1, characterized in that first, second, third and fourth diaphragms are arranged in consecutive order; and the second acoustic cavity connects a space behind the first diaphragm to a space between the fourth diaphragm.

* * * * *